US007950126B2

(12) United States Patent
Hammock

(10) Patent No.: US 7,950,126 B2
(45) Date of Patent: May 31, 2011

(54) SIMPLIFIED METHOD AND APPARATUS FOR MAKING CORED WIRE AND OTHER TUBULAR PRODUCTS

(75) Inventor: Darryl Hammock, Brighton, MI (US)

(73) Assignee: Weld Mold Company, brighton, MI (US)

( * ) Notice: Subject to any disclaimer, the term of this patent is extended or adjusted under 35 U.S.C. 154(b) by 1168 days.

(21) Appl. No.: 11/613,213

(22) Filed: Dec. 20, 2006

(65) Prior Publication Data

US 2008/0148796 A1 Jun. 26, 2008

(51) Int. Cl.
*B23P 11/00* (2006.01)

(52) U.S. Cl. ..... 29/430; 29/458; 72/208; 72/227; 72/268; 72/274; 72/291; 148/23

(58) Field of Classification Search ..... 72/268, 72/227, 208, 274–291; 29/458, 430; 148/23
See application file for complete search history.

(56) References Cited

U.S. PATENT DOCUMENTS 3,318,729 A * 5/1967 Siegle et al. ..... 428/385
4,224,085 A 9/1980 Brendel et al.
6,079,243 A 6/2000 Inoue et al.
6,508,857 B2 1/2003 King et al.
6,649,872 B2 11/2003 Kato et al.
6,674,047 B1 1/2004 Hughes et al.
6,830,632 B1 12/2004 Fuerstenau et al.
2001/0030027 A1 10/2001 Okamura
2005/0044687 A1 3/2005 Matsuguchi et al.
2006/0214313 A1 9/2006 Pieda et al.
2006/0261054 A1 11/2006 Katiyar

* cited by examiner

*Primary Examiner* — Derris H Banks
*Assistant Examiner* — Azm Parvez
(74) *Attorney, Agent, or Firm* — Gifford, Krass, Sprinkle, Anderson & Citkowski, P.C.

(57) ABSTRACT

Improved cored-wire fabrication replaces multiple roller pairs with one or more dies. In the preferred embodiment, flat stock is pulled through a single cylindrical die including an upper tab to ensure and orient the formation of a gap to receive internal powders. Once the powders are introduced, a cylindrical die is used for closure though again, one or more rollers may be used between the powder feed and the die used for closing. In the preferred embodiment, however, a single gap-forming die is used before the powder feed, and a single closing die is used after the powder feed, replacing numerous rollers and other moving parts, thereby dramatically simplifying the apparatus and method of manufacture.

4 Claims, 2 Drawing Sheets

SIMPLIFIED METHOD AND APPARATUS FOR MAKING CORED WIRE AND OTHER TUBULAR PRODUCTS

FIELD OF THE INVENTION

This invention relates generally to the manufacture of tubular structures and, in particular, to methods and apparatus for making cored wire, and the like.

BACKGROUND OF THE INVENTION

Various industrial welding practices utilize cored wire or flux-cored wire as a feedstock. Cored wire typically consists of an outer tubular jacket of mild steel with internal metallic powders suited to the application at hand.

FIG. 1 is a schematic drawing of a machine of the type currently used to produce cored wire. Flat stock 10 is fed into a series of rollers 12, 12', etc., which progressively shape the flat stock into a tubular structure with a gap 20 into which one or more powders 22 are introduced. The rollers 12, 12', etc. provide cup-shaping at smaller and smaller radii until the intermediate tubing with a gap is ultimately realized. After the powders are introduced into the gap, another series of rollers 24, 24', and so forth, are used to compress the powder-containing tube until the gap is fully compressed and sealed within the wire. The wire is then wound onto a spool and typically shipped to a customer in coiled form. Though not shown in the drawing, one or more pulling stages and/or forming dies may be used to reduce the diameter of the wire as desired.

Although machines of the type shown in FIG. 1 are adequate when properly maintained, they require considerable attention due to the thousands of different components and moving parts. As such, not only are machines of this type expensive to build, they are also expensive to operate

SUMMARY OF THE INVENTION

This invention improves upon cored-wire fabrication by replacing the plurality of roller pairs with one or more dies. In the preferred embodiment, flat stock is pulled through a single cylindrical die including an upper tab to ensure and orient the formation of a gap to receive internal powders. One or more sets of rollers and/or the application of heat may optionally be used in advance of this die.

Once the powders are introduced, a cylindrical die is used for closure though again, one or more rollers may be used between the powder feed and the die used for closing. In the preferred embodiment, however, a single gap-forming die is used before the powder feed, and a single closing die is used after the powder feed, replacing numerous rollers and other moving parts, thereby dramatically simplifying the apparatus and method of manufacture.

DETAILED DESCRIPTION OF THE INVENTION

Figure 1:
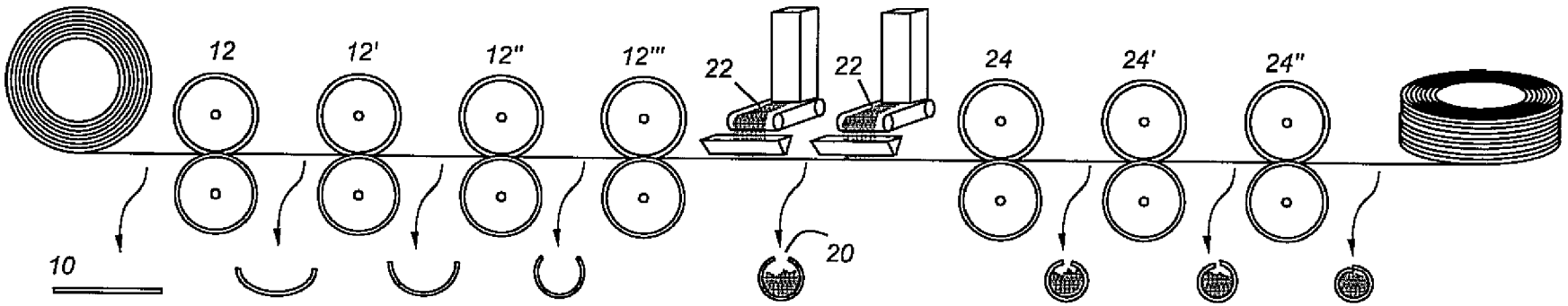
FIG. 1 is a drawing of a prior-art cored wire making machine.
Figure 2:
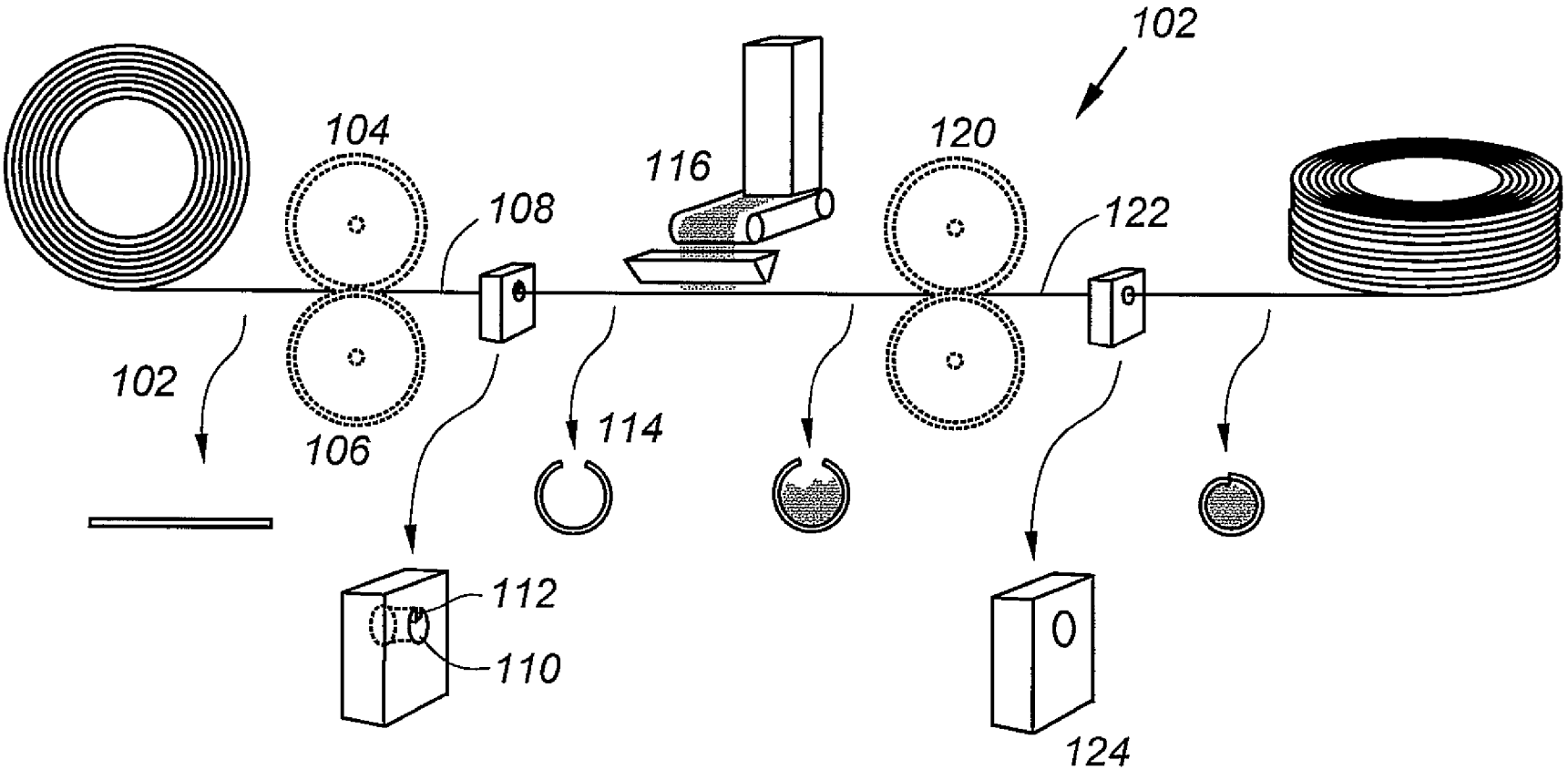
FIG. 2 is a simplified drawing which shows the preferred embodiment of the invention.

Having discussed the prior-art apparatus of FIG. 1, the reader's attention is directed to FIG. 2, which shows the preferred embodiment of the present invention. Flat stock 102 is fed through a die 110 having a tab 112. The entrance to the die 110 is funnel shaped, such that as the flat stock is pulled through the die, an intermediate tubular structure is formed with an appropriately dimensioned and oriented cap 114. Optionally, though not necessary to the invention, one or more sets of rollers 104, 106 and/or heat may be applied to the stock 102 to create a partially formed or softened material 108.

The size of the gap may vary, depending upon the feedstock and desired wire diameter. As one example of many, a 0.135 gap may be used in conjunction with 0.525×0.022 feed material to produce wire in the range of 5/32-0.045. Once the gapped wire is formed, powders are introduced by any conventional or yet-to-be-developed method, such as the use of a conveyor 116 fed by a column, as is now typical in the industry. Once the powders are introduced, the single die 124 is used to close the gap and seal the wire prior to formation of coil 126 for shipping. Optionally, one or more sets of rollers 120 may be used to assist in the closure process. Although lap joints are shown, butt joints may also be accommodated.

As can be seen, the apparatus and method of the invention vastly simplifies the process now in use, resulting in dramatic savings both in terms of cost and complexity. The tab 112 and die are 110 is preferably hardened to assist with longevity. Diamond, carborundum, silicon carbide and other such materials may advantageously be used. Although relatively short die are shown in the drawings, the internal channels may vary up to an inch or more to further increase working life.

Although the apparatus has been described in conjunction with the manufacture of cored wire products, it will be appreciated by those of skill that with appropriate modification, the machine and method may be used to make tubing without internal flux or powders, including brake lines, and the like, as well as larger-diameter structures such as exhaust pipes, and so forth. In these cases, the powder feed delivery subsystem would be replaced with an appropriate welding capability.

I claim:

1. Apparatus for fabricating cored wire, comprising:

a first die operative to transform a flat feedstock into a tubular structure with a lengthwise gap having a width;

the first die including a funnel-shaped entrance and a stationary tab, such that as the flat feedstock is pulled through the die, an intermediate tubular structure is formed with an appropriately dimensioned and oriented gap;

a powder feed system for introducing one or more powders or other substances into the gap; and a second die operative to close the gap, resulting in a sealed wire.

2. The apparatus of claim 1, further including a first set of rollers to partially form the feedstock prior to entry into the first die.

3. The apparatus of claim 1, further including a heat source to partially form the feedstock prior to entry into the first die.

4. The apparatus of claim 1, further including a second set of rollers to partially close the gap in the feedstock prior to entry into the second die.

* * * * *